United States Patent [19]

Grobb et al.

[11] Patent Number: 4,898,056

[45] Date of Patent: Feb. 6, 1990

[54] METHOD AND TOOL FOR PUNCHING PLASTER PLATES

[75] Inventors: Finn Grobb; Kurt Hvalso; Benni Madsen, all of Kalundborg, Denmark

[73] Assignee: Gyproc A/S, Kalundborg, Denmark

[21] Appl. No.: 228,809

[22] Filed: Jul. 29, 1988

Related U.S. Application Data

[63] Continuation-in-part of Ser. No. 33,106, filed as PCT DK86/00077 on Jun. 26, 1986, published as WO87/00116 on Jan. 15, 1987, abandoned.

[30] Foreign Application Priority Data

Jul. 1, 1985 [DK] Denmark ..... 2989/85
Jun. 26, 1986 [WO] PCT Int'l Appl. ..... PCT/DK86/00077

[51] Int. Cl.[4] ..... B26F 1/14

[52] U.S. Cl. ..... 83/689; 83/690; 83/691; 83/622

[58] Field of Search ..... 83/684, 685, 686, 687, 83/688, 689, 690, 691, 622, 50, 52, 55, 679

[56] References Cited

U.S. PATENT DOCUMENTS

| | | | |
|---|---|---|---|
| 858,066 | 6/1907 | Fehr | 83/687 |
| 907,877 | 12/1908 | Rader | 83/301 |
| 2,182,744 | 12/1939 | Ehrsam | 83/689 |
| 2,325,490 | 8/1943 | Wales | 83/686 |
| 2,622,682 | 12/1952 | Kopczynski | 83/686 |
| 2,808,108 | 10/1957 | Pellegrino | 83/686 |
| 3,130,885 | 4/1964 | Fleming | 83/689 |
| 3,143,026 | 8/1964 | Akerson | 83/686 |
| 3,248,977 | 5/1966 | Schneider | 83/868 |
| 3,334,809 | 8/1967 | Zajic et al. | 83/686 |
| 3,504,588 | 4/1970 | Thomas | 83/689 |
| 3,774,425 | 11/1973 | Veneziano | 83/686 |
| 4,228,709 | 10/1980 | Guzay, Jr. et al. | 83/688 |
| 4,257,300 | 3/1981 | Muzik | 83/687 |
| 4,352,309 | 10/1982 | Thalström et al. | 83/622 |

FOREIGN PATENT DOCUMENTS

| | | | |
|---|---|---|---|
| 589679 | 12/1959 | Canada | 83/622 |
| 2758697 | 7/1979 | Fed. Rep. of Germany . | |
| 592179 | 4/1925 | France | 83/689 |
| 442049 | 7/1975 | U.S.S.R. | 83/688 |
| 1172495 | 12/1969 | United Kingdom | 83/689 |

*Primary Examiner*—Frank T. Yost
*Assistant Examiner*—Scott A. Smith
*Attorney, Agent, or Firm*—Darby & Darby

[57] ABSTRACT

In order that holes may be produced in a simple and safe manner in a plaster plate (1) to be used as sound adjuster in a room, holes (15) are punched out of the plate, e.g. in the shape of slits, by means of a cutting tool. Hereby the considerable dust and noise inconveniences caused by the hitherto known machining are avoided. By slits (15) that must lie close to each other, it is possible to punch in two stages, i.e. first with double distance and then in the space between. This prevents fracture of the plaster and tearing of any paper that may be on the surface. The cutting tool is provided with punches (7, 8), in a shape corresponding to the holes. Each punch is provided with an inclined blade (10) which forms an angle of the horizontal of 13°. The cross sectional shape of the blade is V-shaped, with two blades (11) running along the sides of the punch. In this manner the material (9) is punched out in a gentle and even manner, whereby is obtained a perfect hole free from burrs and fractures of the plaster in the edge area.

14 Claims, 5 Drawing Sheets

METHOD AND TOOL FOR PUNCHING PLASTER PLATES

This is a continuation-in-part, of application Ser. No. 033,106, filed as PCT DK86/00077 on Jun. 26, 1986, published as WO87/00116 on Jan. 15, 1987, now abandoned.

The invention relates to a method for punching plaster boards and like plate elements, primarily used for sound adjustment, and a tool for carrying out the method.

Plate elements of this sort are supplied with holes, either in the shape of circular holes or in the shape of slits and are often referred to as acoustic plates. By a suitable mounting of the plates, e.g. in ceilings with mineral wool at the back, an efficient sound adjustment of the time of reverberation of the room may be obtained. This is due to the good sound absorption quality of the plates, which among other things depends on the size and number of the holes. The more material is removed by the punching, the higher the absorption factor.

Hitherto known acoustic plates of plaster are made from existing plaster boards normally coated with paper on both sides.

The plates are then placed under a multi-spindled drilling machine, and the spiral bits drill the many holes through the plates. This requires a complex drilling machine, and it is a time-consuming process because there are limits to the degree of tightening since the plaster easily breaks, and in practice only a limited number of holes can be drilled at a time.

Add to this the drawbacks brought about by the development of dust which is a big nuisance for the operators. Since plaster is fine-grained, it is in practice difficult completely to avoid dust problems by the known protection and suction devices.

Where acoustic plates with oblong holes in the shape of slits are to be made, such plates are also made in a cutting machine, i.e. by means of rotary saw blades mounted on a shared shaft. When the shaft with the saw blades is lowered down into the plate, a trace is produced, the dimension of which depends on the width, diameter and tightening of the saw blade.

The hereby produced saw traces do not always, however, look nice because the plate is not cut into from a right angle at the ends of the slits, where bevelled edges corresponding to the outer periphery of the saw occur. Add to this the tearing of the paper at that end of the slit where the direction of motion of the saw is from below up towards the front surface of the plate.

Apart from these drawbacks that concern the finished product, there are considerable dust and noise inconveniences brought about by these multi-saw machines during operation. The saws raise the plaster dust, and the blades are easily brought to vibrate which produces a very unpleasant noise. Since the plaster plates may only be machined dry these drawbacks cannot be overcome by applying lubricants or the like.

It is the object of the present invention to overcome these drawbacks by the known methods for punching particularly plaster boards, and this is achieved by a method where the hole is punched in a cutting tool. First of all this produces a pure and clean cut, since practice surprisingly has proved that this may be done without causing damage to the plaster or paper in the edge area of the holes. Moreover, the method is completely dustfree and noiseless, which implies that the described method will be preferred in future. Because the punched out material furthermore is easily recovered and recycled, no waste of material whatsoever occurs. Moreover, the method enables fully automatic punching of the plates, since by applying the generally known method the plates are easily punched in a continuous operation.

In order to be able to produce the plates with closely spaced cuts, it is expedient, as referred to in claim 2, to punch the holes in two stages with every other hole at a time.

By using the tool referred to in claim 3, the slit can be punched in a pure and clean manner, because the punching starts at one end of the blade and continues from there until the whole blade has punched the plate.

By, as referred to in claim 4, having the blade take a gently sloping course, the energy requirements of the press—and hence the punching—becomes even and constant, which produces a completely even cut.

Finally it is expedient, as referred to in claim 5, to give the blade a V-shape seen in its transverse direction, to form a blade along each of the side edges of the punch thereby loading the punch completely evenly.

In the following the invention will be described in further detail with reference to the drawing, wherein FIG. 1 shows a section through a tool during punching of a set of slits, FIG. 2 shows a section through the tool seen along II—II in FIG. 1, and FIG. 3 shows a front view of a section of a plate after having been punched.

FIGS. 1 and 2 show examples of a cutting tool for punching holes or slits in a plaster plate 1.

The tool comprises a patrix, the main part 4 of which holds the punches 7, 8 and moves them in and out of the matrix 2, when the pressing piece actuates the tool.

Between the main part 4 and the control plate 5 is fitted a number of helical springs 6 which serve the purpose of ensuring the contact pressure on the plaster plate 1 in the working position. It is indeed important that the control plate is held to abut closely to the plaster plate in order thereby to ensure a pure and clean cut and at the same time serve the purpose of being tearing device in the tool.

The matrix comprises an upper wearing plate 2 with holes 3 and with a base plate below where the punched out material 9 is expelled through the tapered holes, as shown in FIG. 2.

In FIG. 1 the punch 7, 8 is seen from the end. As will appear, the lower blade of the punch is V-shaped in that a centrally running groove 12 together with the sides of the punch form a blade 11 along the side edges of the blade 10. Only every other punch 8 is pressed down to form the slits 5, and the patrix may then be pressed further down in order to punch interjacent slits by means of the shorter punches 7.

In FIG. 2 the punches are pictured from the side. As will appear, each punch 7, 8 is supplied with an inclined blade 10, which may form an angle to the horizontal, i.e. in relation to the matrix, of approx. 13°. This inclination has in practice proved to provide the best cut. When the punching takes place, it starts in the protruding part of the blade 10 and runs evenly from there until the slit 15 has been formed. Since the cutting progresses evenly in the same direction, the punched out material 9 will be led away in an even flow, and there is no risk of blockings.

FIG. 1 is a cross section of the blade 10. This comprises a double-blade 11 running along the two side edges of the punch and is formed by a groove 12 running in the centre of the punch. Hereby occurs a blade 11 which cuts the outer part of the slit first and thus ensures a completely pure and clean cut. Moreover, the punch will be evenly loaded during the punching. In order to even out the loads even more, every other punch may be turned so as to be turned at an angle of 180° in relation to the adjacent punch.

When the method is carried out, a whole plate 1 is placed in the tool with the patrixes lifted. When the plate is placed correctly, i.e. abutting stops or rails, the tool may be actuated to punch the first set of slits. By further pressing, the interjacent slits are punched, and when this punching is completed, the patrix is lifted and the plate may be shifted to the next punching position. This process is repeated until the whole plate is punched and ready for use as an acoustic plate.

An example of a finished plate 1 is shown in section in FIG. 3.

By this method all kinds of holes can be punched, it alone being a question of tool. Thus holes may be punched that deviate from circular and rectangular holes since the capacity of the cutting tool places no limits.

So far reference has only been made to the punching of plaster plates, but it is within the scope of the invention to use the method and tool for corresponding plates such as wallboard, which in use corresponds to plaster board.

What is claimed is:

1. A tool for punching plaster boards manufactured from a hardened plaster comprising punching tools, a patrix having a main part for holding said punching tools, and a control plate, spring means interposed between said main part and said control plate for ensuring a control pressure of said tools on said plaster board, said control plate engaging closely with the plaster board to ensure a clean cut, and a matrix for guiding said punching tools, said matrix having a wearing plate with a plurality of openings for receiving said punching tools and base plate having apertures coinciding with said openings of the wearing plate, said openings being adapted for expelling of a material punched out from said plaster board, each said punching tool having a blade positioned at an angle to a surface of the board, wherein during an operation said plaster board is positioned between an outside surface of said control plate and on outside surface of said wearing plate, whereby punching is first performed to form a number of first slits and thereafter form a number of second slits during a further movement to the patrix, said second slits being punched between said first slits.

2. A tool for punching plaster boards manufactured from a hardened plaster according to claim 1, wherein said angle is about 13°.

3. A tool for punching plaster boards manufactured from a hardened plaster according to claim 1, wherein said blade has substantially V-shaped configuration.

4. A tool for punching plaster boards manufactured from a hardened plaster according to claim 1, wherein said apertures of said base plate have a tapered configuration.

5. A tool for punching plaster boards manufactured from a hardened plaster according to claim 1, further comprising first and second sets of punching tools, said tools of the first set having a length substantially longer than the length of the tools of the second set and only one said set of tools is pressed against the plaster board simultaneously.

6. A tool for punching plaster boards manufactured from a hardened plaster according to claim 5, wherein during the initial movement of the patrix the first set of tools having the longer length is pressed first against the plaster board, during a further movement the patrix is pressed further to punch a second set of slits situated between said first set of slits by means of the shorter tools of the second set.

7. A cutting tool for simultaneous punching of a plurality of substantially elongated, parallel slits in plaster plates, comprising:

a plurality of substantially elongated, thin punching tools a patrix having a main part adopted for holding said elongated punching tools, a control plate for ensuring a control pressure of said punching tools on the plaster board, said control plate engaging closely with the plaster plate to ensure a clean cut, spring means interposed between the main part and the control plate, a matrix for guiding said punching tools, said matrix having a wearing plate with a plurality of substantially elongated openings for receiving said punching tools, said wearing plate having a plurality cutting blades, each of said cutting blades surrounds the opening in the wearing plate and extends outwardly in the direction of said matrix, whereby during operation of the cutting tool said cutting blades penetrate and cut a portion of the plaster plate adjacent to the wearing plate and along the sides of the holes to be cut providing additional support for the plate and ensuring a clean cut.

8. A cutting tool according to claim 7, wherein a before plate having aperture coinciding with said openings of the wearing plat being provided, said openings being adopted for expelling a material punched out from the plaster plate.

9. A cutting tool according to claim 8, wherein said cutting blade has a substantially elongated configuration surrounding all edges of the opening in the wearing plate.

10. A cutting tool according to claim 7, wherein each said punching tool has a free working end, said working end being provided with a V-shaped groove extending along the length of the tool.

11. A cutting tool according to claim 7, wherein each said punching tool, said opening in the wearing plate and the cutting blade surrounding said opening have substantially elongated configuration, each having at least two sides substantially parallel to each other.

12. A cutting tool according to claim 7, wherein the sides of the blade are bevelled to form an angle of approximately 24° to a horizontal.

13. A cutting tool according to claim 7, wherein the blade has a concave curved cross-sectional shape for the formation of a blade along each side edge of the blade.

14. A cutting tool according to claim 13, wherein the concave curved cross-sectional shape has a rounded center.

* * * * *

UNITED STATES PATENT AND TRADEMARK OFFICE

CERTIFICATE OF CORRECTION

PATENT NO. : 4,898,056

DATED : February 6, 1990

INVENTOR(S) : Finn Grobb, et al

It is certified that error appears in the above-indentified patent and that said Letters Patent is hereby corrected as shown below:

Column 1, beginning at line 1, through column 6, should be deleted and replaced with the attached information:

Signed and Sealed this

Sixth Day of December, 1994

*Attest:*

Bruce Lehman

BRUCE LEHMAN

*Attesting Officer*

*Commissioner of Patents and Trademarks*

METHOD AND TOOL FOR PUNCHING PLASTER PLATES

CROSS-REFERENCE TO RELATED APPLICATIONS

This is a continuation-in-part application of U.S. Ser. No. 033,106, filed Feb. 19, 1987, now abandoned.

BACKGROUND OF THE INVENTION

The invention relates to a method for punching plaster boards and like plate elements, primarily used for sound adjustment, and a tool for carrying out the method.

Plate elements of this sort are supplied with holes, either in the shape of circular holes or in the shape of slits and are often referred to as acoustic plates. By a suitable mounting of the plates, e.g. in ceilings with mineral wool at the back, an efficient sound adjustment of the time of reverberation of the room may be obtained. This is due to the good sound absorption quality of the plates, which among other things depends on the size and number of the holes. The more material is removed by the punching, the higher the absorption factor.

Hitherto known acoustic plates of plaster are made from existing plaster boards normally coated with paper on both sides.

The plates are then placed under a multi-spindled drilling machine, and the spiral bits drill the many holes through the plates. This requires a complex drilling machine, and it is a time-consuming process because there are limits to the degree of tightening since the plaster easily breaks, and in practice only a limited number of holes can be drilled at a time.

Add to this the drawbacks brought about by the development of dust which is a big nuisance for the operators. Since plaster is fine-grained, it is in practice difficult completely to avoid dust problems by the known protection and suction devices.

Where acoustic plates with oblong holes in the shape of slits are to be made, such plates are also made in a cutting machine, i.e. by means of rotary saw blades mounted on a shared shaft. When the shaft with the saw blades is lowered down into the plate, a trace is produced, the dimension of which depends on the width, diameter and tightening of the saw blade.

The hereby produced saw traces do not always, however, look nice because the plate is not cut into from a right angle at the ends of the slits, where bevelled edges corresponding to the outer periphery of the saw occur. Add to this the tearing of the paper at that end of the slit where the direction of motion of the saw is from below up towards the front surface of the plate.

Apart from these drawbacks that concern the finished product, there are considerable dust and noise inconveniences brought about by these multi-saw machines during operation. The saws raise the plaster dust, and the blades are easily brought to vibrate which produces a very unpleasant noise. Since the plaster plates may only be machined dry these drawbacks cannot be overcome by applying lubricants or the like.

The acoustic plates consist of a plaster plate where both faces are coated with paper serving to strengthen the acoustic plate and improve its appearance. The acoustic plates are provided with holes either in the shape of round holes of preferably in the form of oblong parallel slits.

When holes are to be punched in such acoustic plate, the composition of the plate causes certain difficulties because the paper layers will tend to be torn off the surfaces of the plaster plate in that the lower layer of paper by the motion of the punch out through the bottom side of the acoustic plate is easily pushed away from the bottom surface of the plaster plate. The upper layer of paper is easily torn off the upper surface of the plaster plate by the extraction of the punch from the acoustic plate. Moreover, the plaster plate is highly fragile. In view of that during punching of the holes, cracks are produced and the plaster dust will fall from the holes during the subsequent use of the acoustic plate.

The above drawbacks in connection with the punching of such acoustic plates become particularly serious when the holes must be in the form of oblong parallel slits situated close to each other.

SUMMARY OF THE INVENTION

It is the object of the present invention to overcome these drawbacks by the known methods for punching particularly plaster boards, and this is achieved by a method where the hole is punched in a cutting tool. First of all this produces a pure and clean cut, since practice surprisingly has proved that this may be done without causing damage to the plaster or paper in the edge area of the holes. Moreover, the method is completely dust-free and noiseless, which implies that the described method will be preferred in future. Because the punched out material furthermore is easily recovered and recycled, no waste of material whatsoever occurs. Moreover, the method enables fully automatic punching of the plates, since by applying the generally known method the plates are easily punched in a continuous operation.

In order to be able to produce the plates with closely spaced cuts, it is expedient to punch the holes in two stages with every other hole at a time.

By using the tool, the slit can be punched in a pure and clean manner, because the punching starts at one end of the blade and continues from there until the whole blade has punched the plate.

By having the blade take a gently sloping course, the energy requirements of the press—and hence the punching—becomes even and constant, which produces a completely even cut.

Finally it is expedient to give the blade a V-shape seen in its transverse direction, to form a blade along each of the side edges of the punch thereby loading the punch completely evenly.

In the following the invention will be described in further detail with reference to the drawings.

DESCRIPTION OF THE PREFERRED EMBODIMENTS

Figure 1:
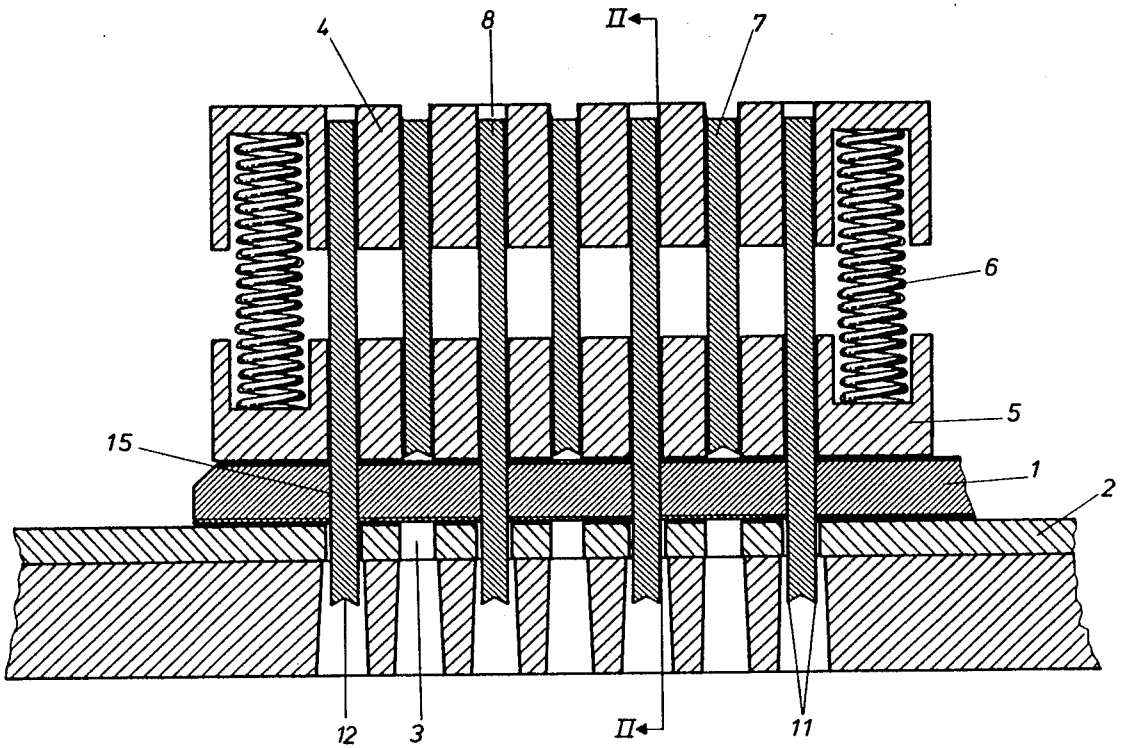
FIG. 1 shows a section through a tool during punching of a set of slit in accordance with a first embodiment.
Figure 2:
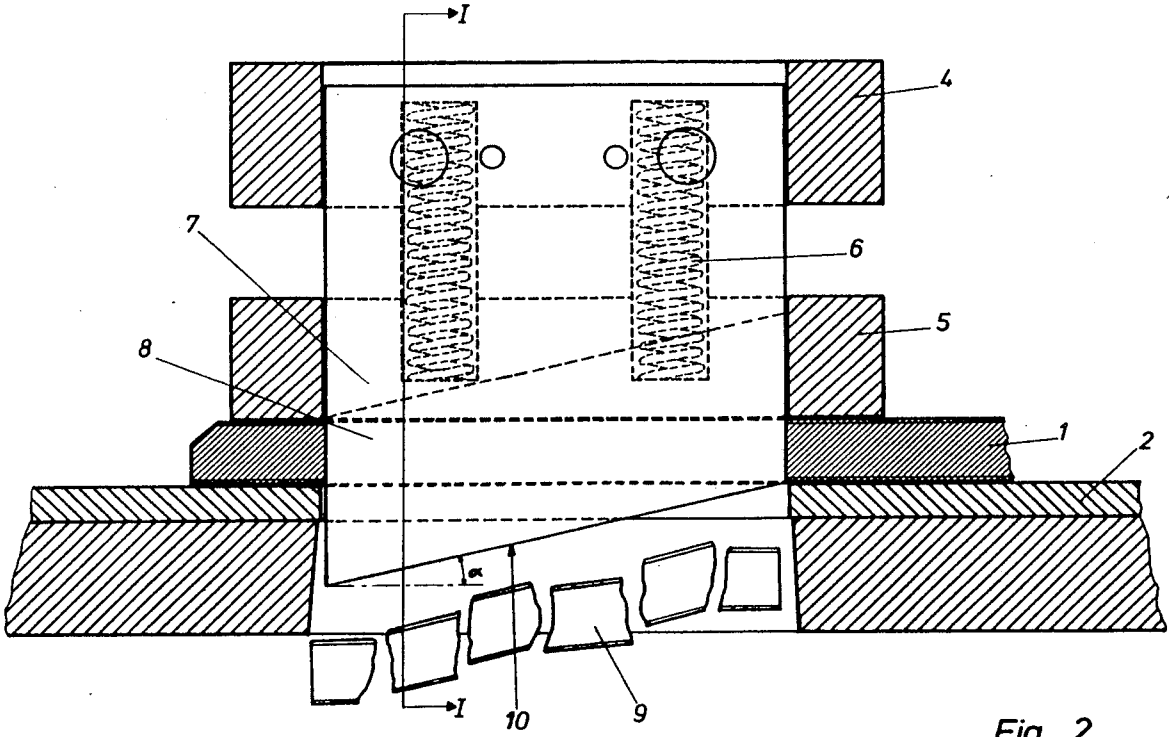
FIG. 2 shows a section through the tool seen along II—II in FIG. 1.

FIGS. 1 and 2 show examples of a cutting tool for punching holes or slits in a plaster plate 1.

The tool comprises a patrix, the main part 4 of which holds the punches 7, 8 and moves them in and out of the matrix 2, when the pressing piece actuates the tool.

Between the main part 4 and the control plate 5 is fitted a number of helical springs 6 which serve the purpose of ensuring the contact pressure on the plaster plate 1 in the working position. It is indeed important that the control plate is held to abut closely to the plaster plate in order thereby to ensure a pure and clean cut and at the same time serve the purpose of being a tearing device in the tool.

The matrix comprises an upper wearing plate 2 with holes 3 and with a base plate below where the punched out material 9 is expelled through the tapered holes, as shown in FIG. 2.

In FIG. 1 the punch 7, 8 is seen from the end. As will appear, the lower blade of the punch is V-shaped in that a centrally running groove 12 together with the sides of the punch form a blade 11 along the side edges of the blade 10. Only every other punch 8 is pressed down to form the slits 5, and the patrix may then be pressed further down in order to punch interjacent slits by means of the shorter punches 7.

In FIG. 2 the punches are pictured from the side. As will appear, each punch 7, 8 is supplied with an inclined blade 10, which may form an angle to the horizontal, i.e. in relation to the matrix, of approx. 13°. This inclination has in practice proved to provide the best cut. When the punching takes place, it starts in the protruding part of the blade 10 and runs evenly from there until the slit 15 has been formed. Since the cutting progresses evenly in the same direction, the punched out material 9 will be led away in an even flow, and there is no risk of blockings.

FIG. 1 is a cross section of the blade 10. This comprises a double-blade 11 running along the two side edges of the punch and is formed by a groove 12 running in the centre of the punch. Hereby occurs a blade 11 which cuts the outer part of the slit first and thus ensures a completely pure and clean cut. Moreover, the punch will be evenly loaded during the punching. In order to even out the loads even more, every other punch may be turned so as to be turned at an angle of 180° in relation to the adjacent punch.

When the method is carried out, a whole plate 1 is placed in the tool with the patrixes lifted. When the plate is placed correctly, i.e. abutting stops or rails, the tool may be actuated to punch the first set of slits. By further pressing, the interjacent slits are punched, and when this punching is completed, the patrix is lifted and the plate may be shifted to the next punching position. This process is repeated until the whole plate is punched and ready for use as an acoustic plate.

Figure 3:
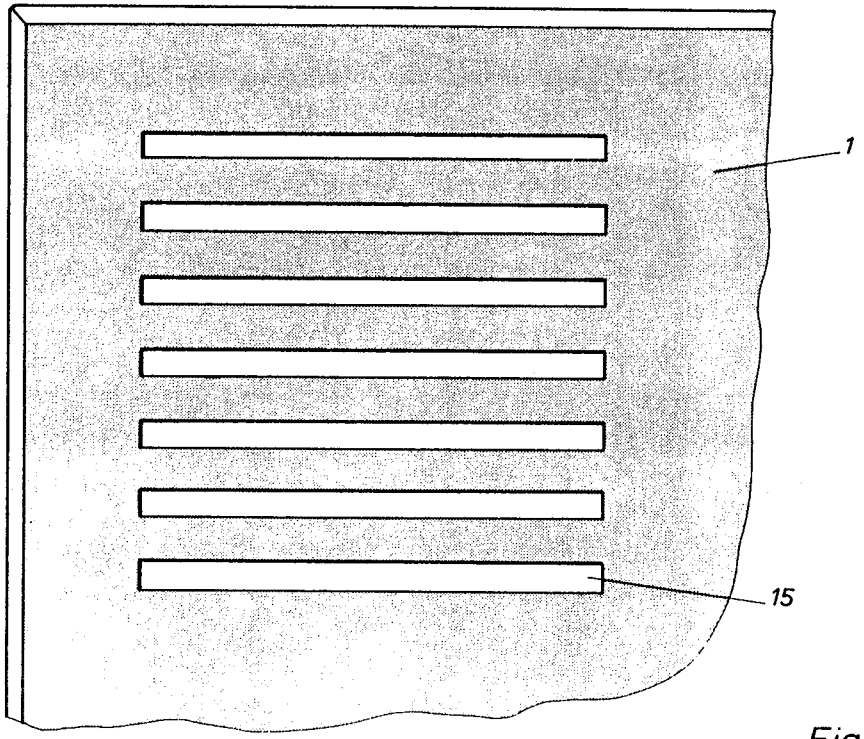
FIG. 3 shows a front view of a section of a plate after having been punched.

An example of a finished plate 1 is shown in section in FIG. 3.

By this method all kinds of holes can be punched, it alone being a question of tool. Thus, holes may be punched that deviate from circular and rectangular holes since the capacity of the cutting tool places no limits.

So far reference has only been made to the punching of plaster plates, but it is within the scope of the invention to use the method and tool for corresponding plates such as wallboard, which in use corresponds to plaster board.

Figure 4:
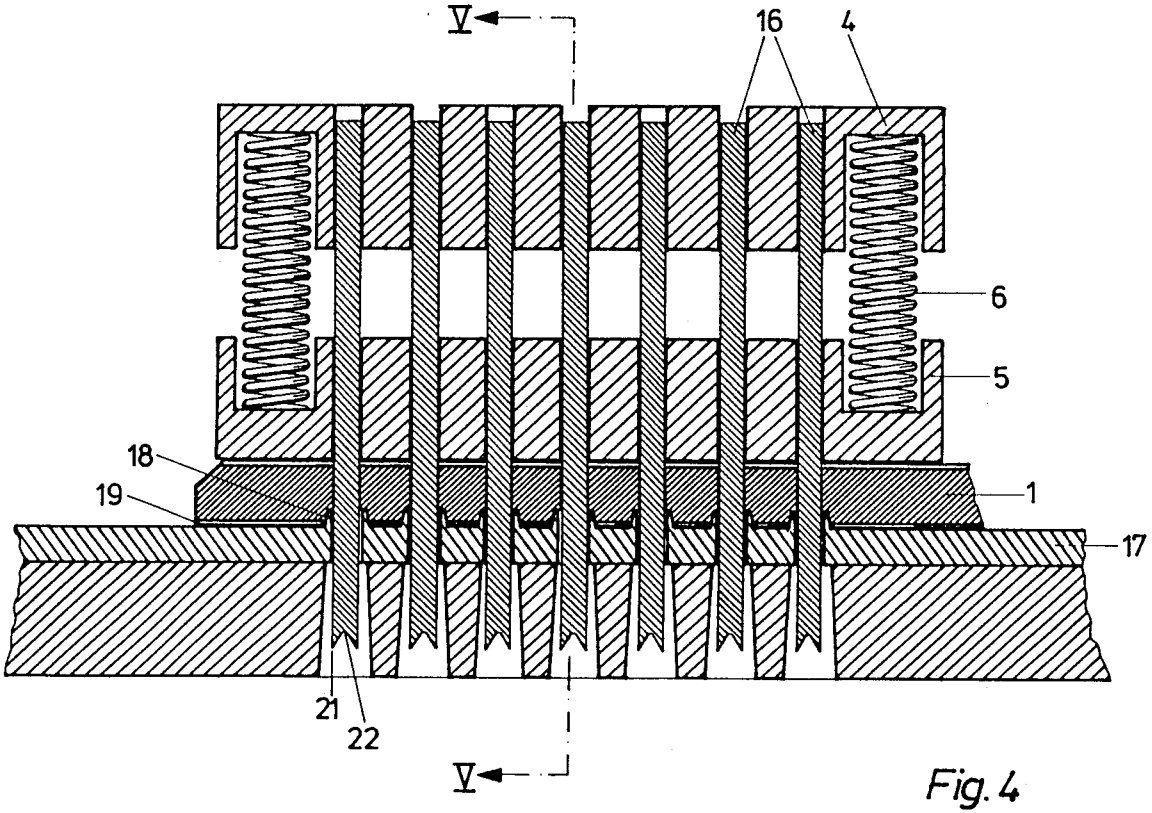
FIG. 4 shows a section through a tool during punching of a set of slits in accordance with a second embodiment.
Figure 5:
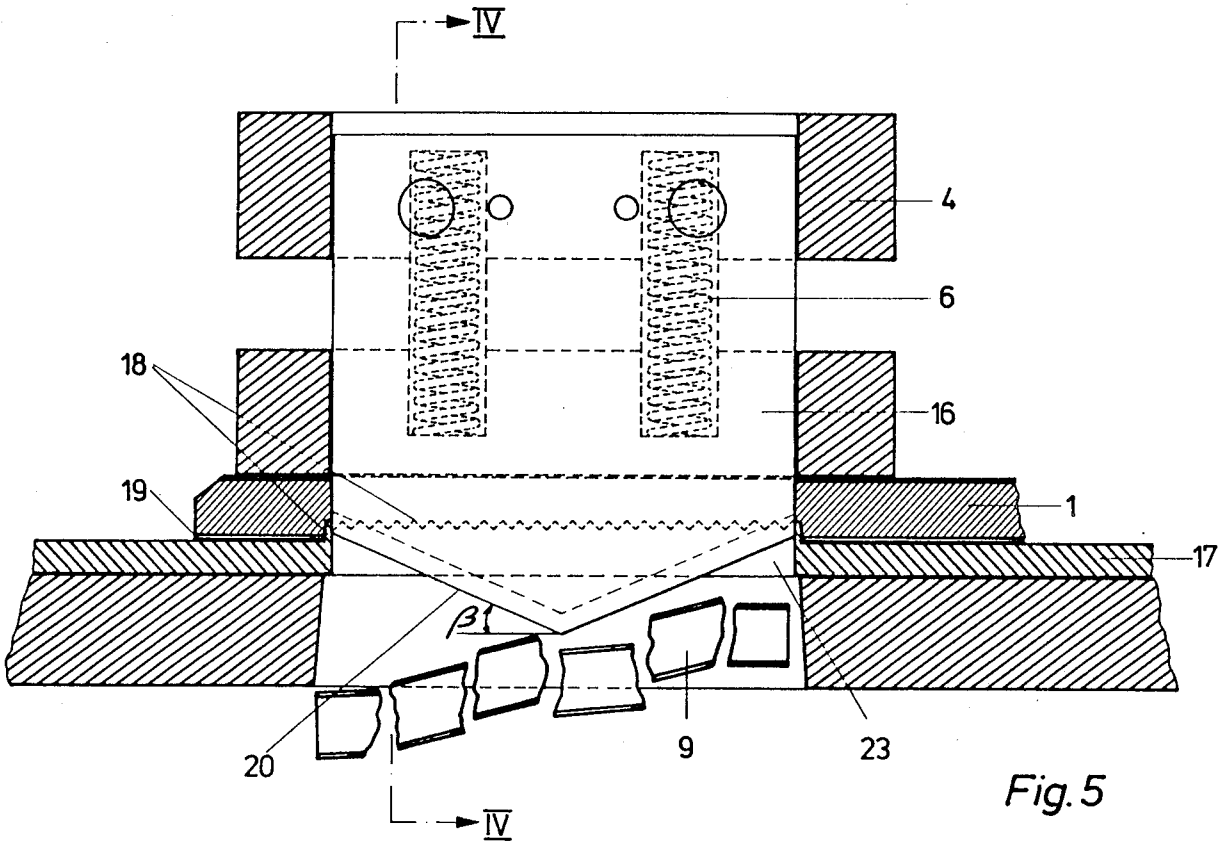
FIG. 5 shows a cross section taken across section lines V—V of FIG. 4.

FIGS. 4 and 5 show a further embodiment of a cutting tool according to the invention capable of punching oblong slits in a plaster plate by punching all the slits in one operation, i.e. by pressing down the punches 16 only once.

The cutting tool according to FIGS. 4 and 5 comprises a patrix whose main part 4 holds the punches 16 which can be moved in and out of the wearing plate 17 of the matrix. Moreover, helical springs 6 are provided in order to ensure the contact pressure on the plaster plate 1 in the operational position of the cutting tool.

In this embodiment the wearing plate 17 is provided with an upwardly turned blade 18 along the four side edges of all the holes 23, which blade can be jagged as indicated in FIG. 5. This blade 18 serves the purpose of perforating or perhaps cutting the cover layer of cardboard 19 which is placed on the underside of the plaster plate 17. When the plaster plate is placed in the tool it will be pressed down toward the matrix 17 whereby the blades 18 will cut through the cover layer 19 along the sides of the holes. This provides a clean cut of the holes in the bottom face, because the edges of the holes are sharply cut as opposed to previously when the side edges might be frayed after the punching.

As shown in FIG. 5 the blade is V-shaped so that the bevelled edges form an angle of approximately 24° to the horizontal. Moreover, the cross section of the blades 20 is U-shaped, as shown in FIG. 4, with side blades 21 and a rounding 22 at the center.

By constructing the blades in this manner, the force of pressure can be reduced to about half the force of pressure of previously known tools in that the punching begins at the center of the holes and is made from the center towards the sides. Consequently, the punches are not subjected to any sideways force, and the punching of the plaster 9 becomes more even. Since the tool has also caused a weakening of the cardboard layer 19 on the bottom surface of the plaster plate, the punching will become simple and precise leaving sharp side edges.

The rounding 22 between the blades 21 prevent plaster dust and cardboard scraps from being compressed and filling the blade, because the dust and cardboard will fall out of the blade. This preserves the full cutting effect of the cutting tool during the operation, which in turn causes the force of pressure to be halved, leaving the finished result more even and sharper than what has hitherto been accomplished.

What is claimed is:

1. A tool for punching plaster boards manufactured from a hardened plaster comprising punching tools, a patrix having a main part for holding said punching tools, and a control plate, spring means interposed between said main part and said control plate for ensuring a control pressure of said tools on said plaster board, said control plate engaging closely with the plaster board to ensure a clean cut, and a matrix for guiding said punching tools, said matrix having a wearing plate with a plurality of openings for receiving said punching tools and base plate having apertures coinciding with said openings of the wearing plate, said openings being adapted for expelling of a material punched out from said plaster board, each said punching tool having a blade positioned at an angle to a surface of the board, wherein during an operation said plaster board is positioned between an outside surface of said control plate and on outside surface of said wearing plate, whereby punching is first performed to form a number of first slits and thereafter form a number of second slits during a further movement of the patrix, said second slits being punched between said first slits.

2. A tool for punching plaster boards manufactured from a hardened plaster according to claim 1, wherein said angle is about 13°.

3. A tool for punching plaster boards manufactured from a hardened plaster according to claim 1, wherein said blade has substantially V-shaped configuration.

4. A tool for punching plaster boards manufactured from a hardened plaster according to claim 1, wherein said apertures of said base plate have a tapered configuration.

5. A tool for punching plaster boards manufactured from a hardened plaster according to claim 1, further comprising first and second sets of punching tools, said tools of the first set having a length substantially longer than the length of the tools of the second set and only one said set of tools is pressed against the plaster board simultaneously.

6. A tool for punching plaster boards manufactured from a hardened plaster according to claim 5, wherein during the initial movement of the patrix the first set of tools having the longer length is pressed first against the plaster board, during a further movement the patrix is pressed further to punch a second set of slits situated between said first set of slits by means of the shorter tools of the second set.

7. A cutting tool for simultaneous punching of a plurality of substantially elongated, parallel slits in plaster plates, comprising a plurality of substantially elongated, thin punching tools a patrix having a main part adopted for holding said elongated punching tools, a control plate for ensuring a control pressure of said punching tools on the plaster board, said control plate engaging closely with the plaster plate to ensure a clean cut, spring means interposed between the main part and the control plate, a matrix for guiding said punching tools, said matrix having a wearing plate with a plurality of substantially elongated openings for receiving said punching tools, said wearing plate having a plurality cutting blades, each of said cutting blade surrounds the opening in the wearing plate and extends outwardly in the direction of said matrix, whereby during operation of the cutting tool said cutting blades penetrate and cut a portion of the plaster plate adjacent to the wearing plate and along the sides of the holes to be cut providing additional support for the plate and ensuring a clean cut.

8. A cutting tool according to claim 7, wherein a before plate having aperture coinciding with said openings of the wearing plate being provided, said openings being adopted for expelling a material punched out from the plaster plate.

9. A cutting tool according to claim 8, wherein said cutting blade has a substantially elongated configuration surrounding all edges of the opening in the wearing plate.

10. A cutting tool according to claim 7, wherein each said punching tool has a free working end, said working end being provided with a V-shaped groove extending along the length of the tool.

11. A cutting tool according to claim 7, wherein each said punching tool, said opening in the wearing plate and the cutting blade surrounding said opening have substantially elongated configuration, each having at least two sides substantially parallel to each other.

12. A cutting tool according to claim 7, wherein the sides of the blade are bevelled to form an angle of approximately 24° to a horizontal.

13. A cutting tool according to claim 7, wherein the blade has a concave curved cross-sectional shape for the formation of a blade along each side edge of the blade.

14. A cutting tool according to claim 13, wherein the concave curved cross-sectional shape has a rounded center.

* * * * *